US005303930A

United States Patent [19]

Saiz

[11] Patent Number: 5,303,930

[45] Date of Patent: Apr. 19, 1994

[54] BOARD FOR THE PLAYING OF MULTIPLE BOARD GAMES

[75] Inventor: Aurelio S. Saiz, Madrid, Spain

[73] Assignee: Ediciones Pleyades, S.A., Madrid, Spain

[21] Appl. No.: 26,482

[22] Filed: Mar. 4, 1993

[30] Foreign Application Priority Data

Mar. 4, 1992 [ES] Spain ..... 9200485

[51] Int. Cl.[5] ..... A63F 3/00

[52] U.S. Cl. ..... 273/283

[58] Field of Search ..... 273/275, 276, 283, 284, 273/146, 287

[56] References Cited

U.S. PATENT DOCUMENTS

| | | | |
|---|---|---|---|
| 3,608,902 | 9/1971 | Weisbecker | 273/283 X |
| 3,692,310 | 9/1972 | Martin | 273/283 X |
| 4,552,363 | 11/1985 | Rehkemper et al. | 273/284 X |
| 4,614,344 | 9/1986 | O'Connor | 273/284 X |
| 4,625,971 | 12/1986 | Ferguson | 273/283 X |
| 4,828,268 | 5/1989 | Somerville | 273/283 |
| 4,930,788 | 6/1990 | Roccanova | 273/146 X |

FOREIGN PATENT DOCUMENTS

| | | | |
|---|---|---|---|
| 2499864 | 8/1982 | France | 273/283 |

*Primary Examiner*—William Stoll

*Attorney, Agent, or Firm*—Young & Thompson

[57] ABSTRACT

New board for the playing of multiple board games, characterized in that it is composed of an indeterminate number of modules, each one formed by a large number of blocks which surround another block which makes up the center or nucleus of each module, and all of them are differentiated among themselves using colors and/or combinations of colors which result in the deformation of a large number of winding paths, of different colors, which cross each other and which can be moved through with the help of a die provided with pips or another provided with colors.

5 Claims, 6 Drawing Sheets

| | | |
|---|---|---|
| 3 | 1 | 2 |
| 4 | A | 3 |
| 1 | 2 | 4 |

FIG. 1

| | | | | | | | | |
|---|---|---|---|---|---|---|---|---|
| 3 | 1 | 2 | 3 | 1 | 2 | 3 | 1 | 2 |
| 4 | A | 3 | 4 | A | 3 | 4 | A | 3 |
| 1 | 2 | 4 | 1 | 2 | 4 | 1 | 2 | 4 |
| 3 | 1 | 2 | 3 | 1 | 2 | 3 | 1 | 2 |
| 4 | A | 3 | 4 | A | 3 | 4 | A | 3 |
| 1 | 2 | 4 | 1 | 2 | 4 | 1 | 2 | 4 |
| 3 | 1 | 2 | 3 | 1 | 2 | 3 | 1 | 2 |
| 4 | A | 3 | 4 | A | 3 | 4 | A | 3 |
| 1 | 2 | 4 | 1 | 2 | 4 | 1 | 2 | 4 |

FIG. 2

BOARD FOR THE PLAYING OF MULTIPLE BOARD GAMES

FIELD OF THE INVENTION

The present invention relates to a new board for playing multiple board games.

BACKGROUND OF THE INVENTION

All board games known up to now, the playing of which requires the use of a board with blocks and one or more dice, exhibit the common characteristic that each game requires a specific board, in other words, a board whose blocks are arranged and/or combined among themselves in the particular manner needed for the playing of the game, and only that game, which is in question.

These blocks generally form one or more paths which must necessarily be moved through. But, even when these paths are varied, they are always branches of a main path and, consequently, the options and possibilities they offer to players are very limited.

Furthermore, with respect to the dice used for the playing of those known games, it is common to use only one of the traditional dice with points, or, in some cases, when it involves a special game, a die that is also special and provided with numbers, figures or colors.

SUMMARY OF THE INVENTION

The present invention constitutes a real innovation in the matter, inasmuch as what is intended with it is not to protect the rules of any game in particular, but rather to contribute to the common wealth of board games a particular kind of board, whose blocks, by virtue of their special characteristics, arrangement and/or combination, form a multiplicity of paths, that are not preset, that make it possible for this board to be used for the playing of a practically unlimited number of different games.

The board for board games according to the invention is essentially characterized in that it is made up of an indeterminate number of modules, and each one of these modules is formed by a large number of blocks that surround another block, symmetrical to those blocks, that makes up the center or nucleus of each module, and all the modules are arranged in such a way that, together, they compose a geometric figure of any shape.

According to another characteristic of the invention, the blocks, which in each module surround the center block or nucleus exhibit distinct colors that differentiate them by pairs of blocks not adjacent to one another, so that the center block or nucleus is likewise differentiated from all the others by means of another color or combination of colors, and the blocks are arranged in each and every module in such a way that those of the same color always occupy the same position with respect to the center block or nucleus and that the nucleus borders with at least two blocks of each color.

According to an additional characteristic of the invention, the center block or nucleus of each one of the modules is connected to all the blocks that surround it and these blocks are connected to those of their same color in the adjacent modules and, if desired, also among themselves and/or to others of different color in those adjacent modules, directly, by reciprocal contact, if the shape of these blocks allow it, or indirectly, by way of connections of any kind, and thus the blocks of all modules of the board form a large number of winding paths, of different colors, which cross one another and which can be potentially moved through with the help of two dice, one of which, provided with points, determines the number of blocks to be moved through, while the die, provided with the same colors as the blocks exhibit, indicates the path to be followed.

The characteristics of the object in question are described below with reference to the drawings of the attached plan sheets, in which some embodiments of the invention, presented as examples and not having limiting character, are represented; therefore any variations of it of whatever nature, as long as they are merely peripheral and do not cause a new and distinct industrial result to be obtained, should be considered to be included within the scope of protection deriving from the registration for which application is being made.

BRIEF DESCRIPTION OF THE DRAWINGS

FIGS. 1, 3 and 5 each represent top views of three embodiments of the module, obtained by grouping the blocks, which makes possible the composition of different game boards according to the invention.

FIGS. 2, 4 and 6 each represent partial top views of three boards according to the invention, formed by juxtaposing and combining nine modules identical to those illustrated in FIGS. 1, 3 and 5 respectively.

DETAILED DESCRIPTION OF THE INVENTION

In the embodiment represented in FIGS. 1 and 2 and which illustrates the basic concept of the invention, each one of the modules is formed by nine square and symmetrical blocks which form a square of three blocks per side, i.e. arranged in such a way that eight of them (1—1, 2—2, 3—3 and 4—4) surround the ninth one (A) which is located in the center of the module, as a nucleus of the module.

The eight blocks 1—1, 2—2, 3—3 and 4—4 are, since they are pairs of blocks not adjacent to one another, of different colors (for example, the 1—1's are purple colored, the 2—2's are green colored, the 3—3's are blue colored and 4—4'are orange colored), while the center block or nucleus A exhibits a color or combination of colors which makes it possible to differentiate it from the rest.

Blocks 1—1, 2—2, 3—3 and 4—4 of each module appear joined to each other and to the center block or nucleus A by direct contact of their sides and/or vertices. And in the same way they will end up joined to the blocks of the adjacent modules, since they are juxtaposed to compose the board.

The center of the portion of the board illustrated in this embodiment is made up of the center block or nucleus A of the center module. And the same will occur with the entire board, as long as the number of the modules which make it up is uneven. In contrast, whenever the number of the component modules of the board is even, the center of the board will end up being constituted by the four blocks corresponding to the same number of corners, that are adjacent to one another, of the four center modules. Preferably, those four blocks will be also differentiated from all the others by means of different colors or combinations of colors.

Nevertheless, there likewise is room for the possibility that the center of the board is made to consist of any other figure that could be fancied or of a single space, either white or colored, as long as its overall shape is suitable to allow for its connection, in the manner indicated above, with the modules that are to surround this element occupying the center of the board.

Figure 3:
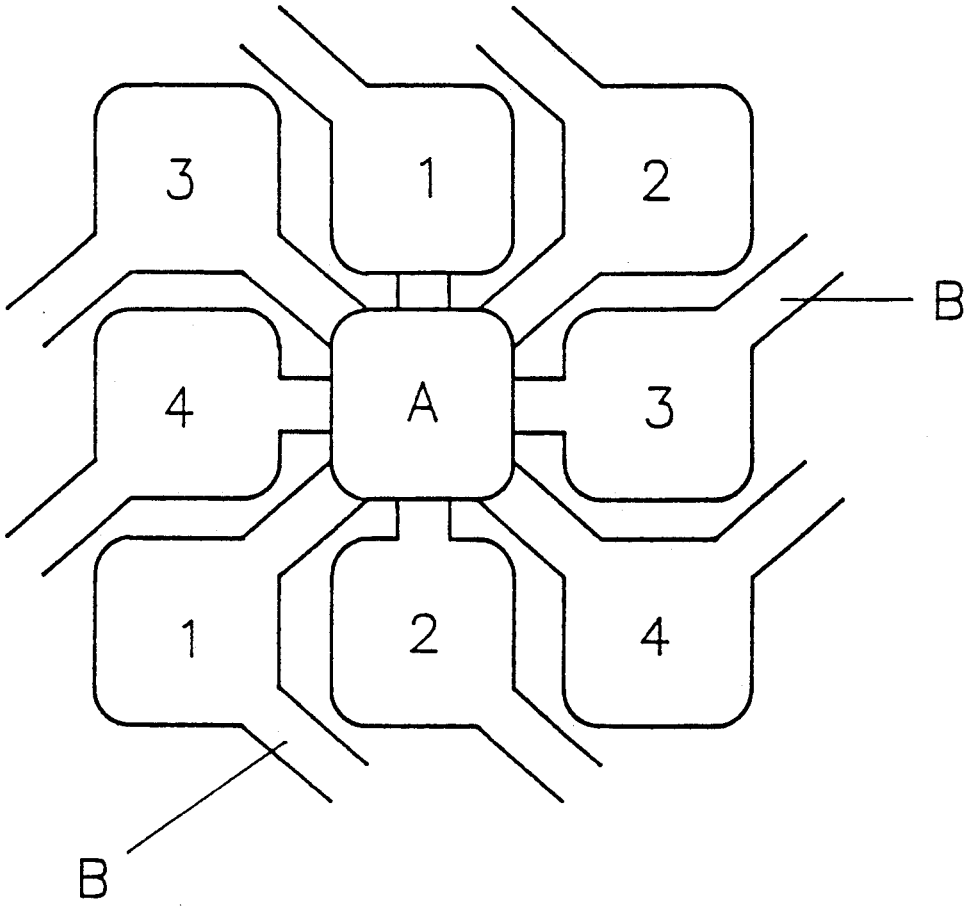
Figure 4:
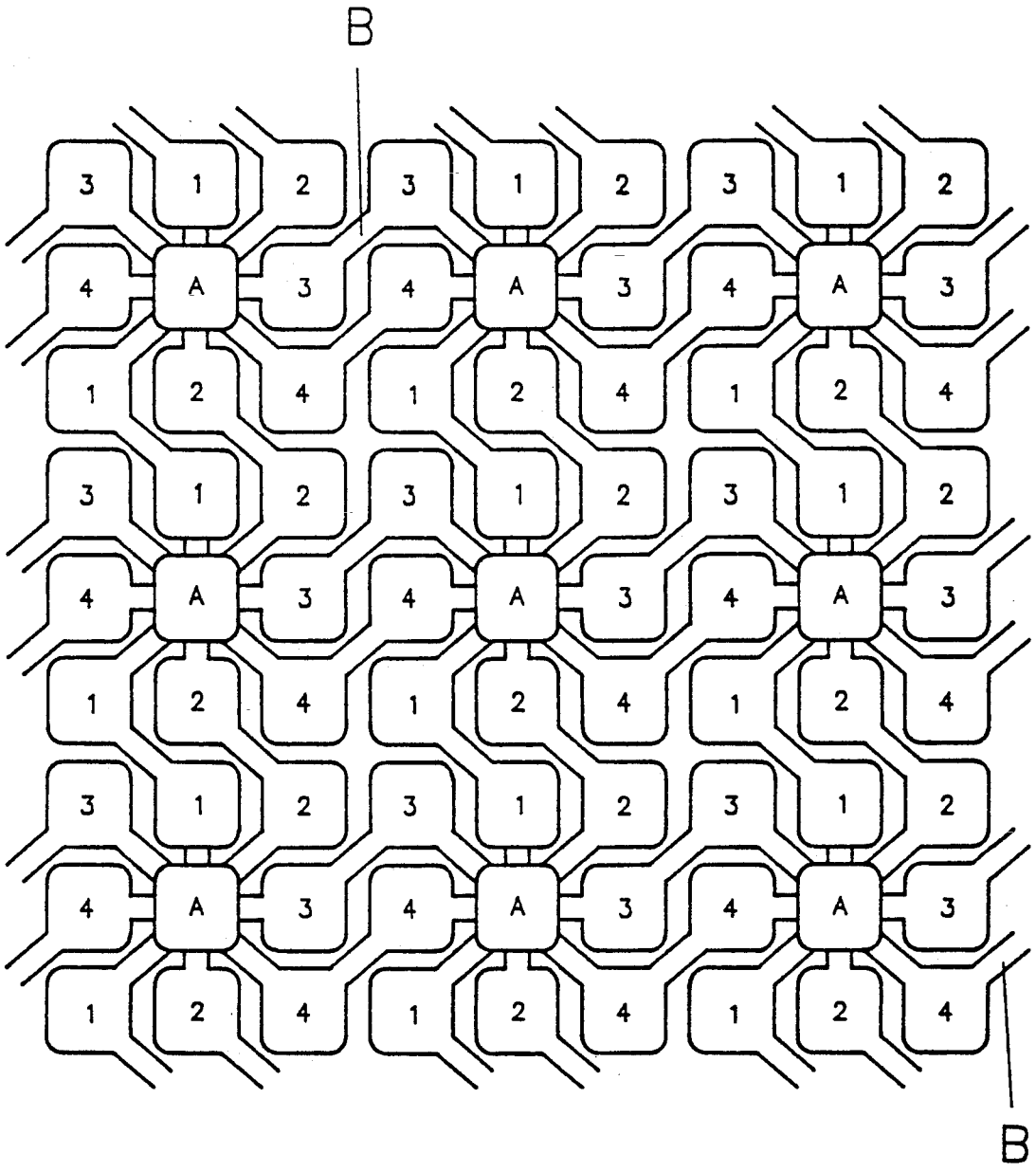

The embodiment of the invention represented in FIGS. 3 and 4 is differentiated from that illustrated in FIGS. 1 and 2 only in that all the blocks of each module appear slightly separated from each other and from the blocks of the adjacent modules, while the center block or nucleus A of each module is connected to each and every one of blocks 1—1, 2—2, 3—3 and 4—4 which surround it, and these are connected to those having the same color of the adjacent modules by means of small corridors (B) of the same color as the blocks to which they belong. Thus, corridor B which connects blocks 1—1 to center block A and to blocks 1 of the adjacent modules will be purple, that which connects blocks 2—2 to center block A and to blocks 2 of the adjacent modules will be green, etc.

There is also room for the possibility that corridors B will be replaced by any other means of connection whatsoever (for example, simple lines, arrows, etc.), either colored or not, and that blocks 1—1, 2—2, 3—3 and 4—4 will be also connected to one another and/or to others having a different color of the adjacent modules.

Figure 5:
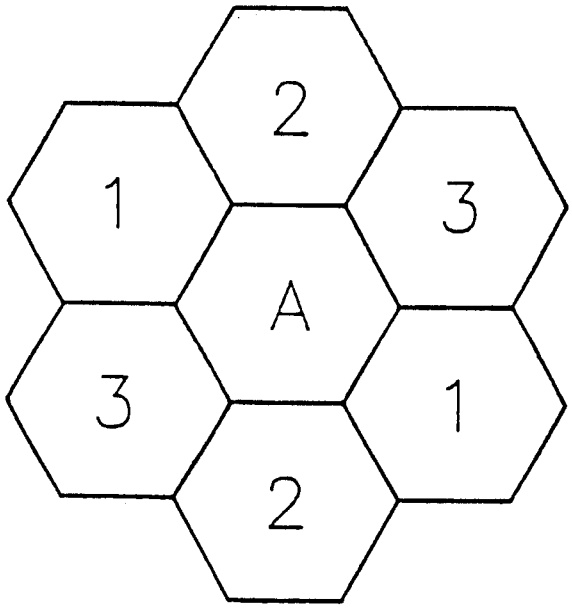
Figure 6:
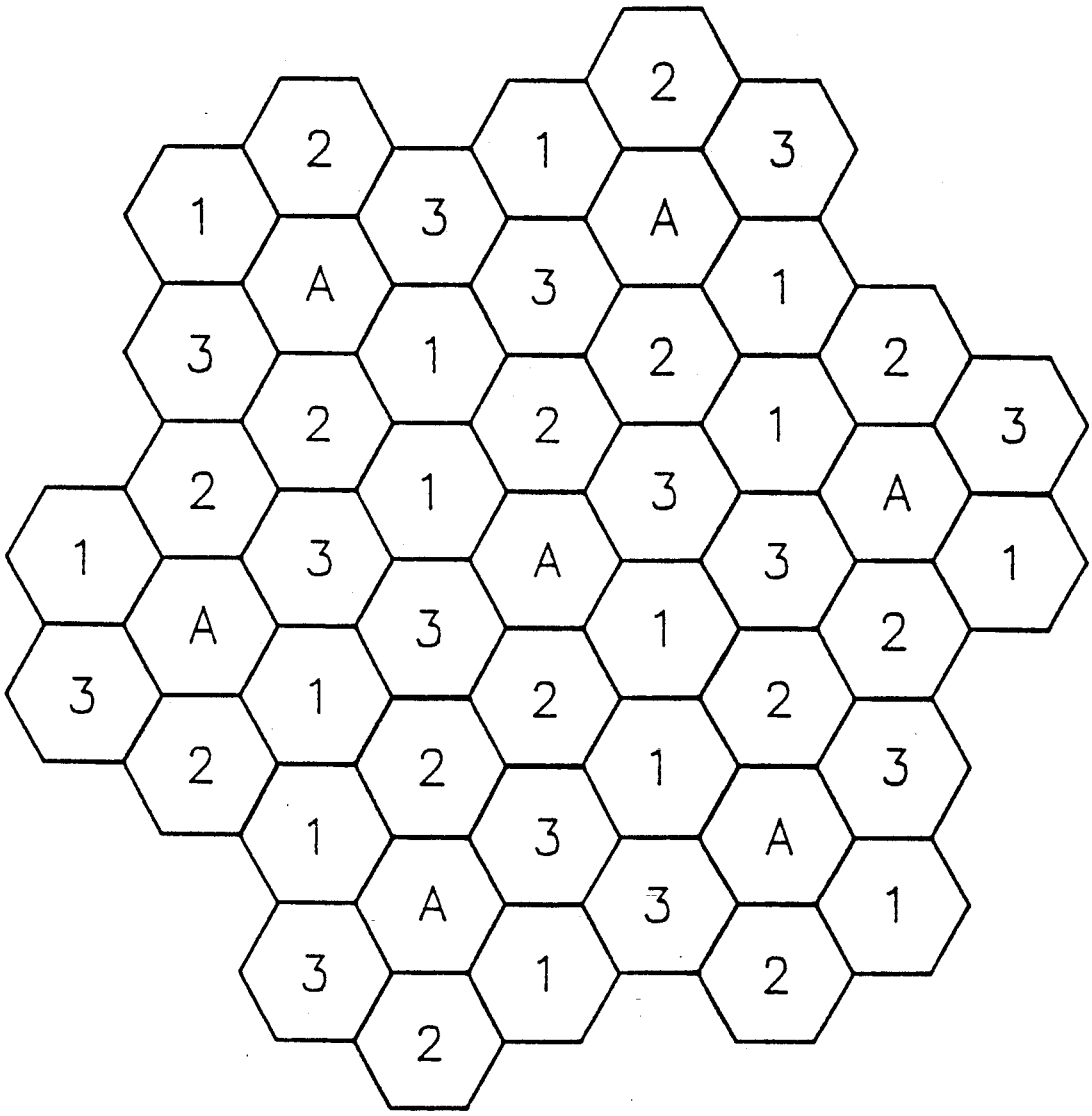

In the embodiment illustrated in FIGS. 5 and 6, each module is formed by seven blocks: the center block or nucleus A and another six, 1—1, 2—2 and 3—3, grouped around it.

They all have the same hexagonal shape, which allows them to remain joined to one another and to those of the adjacent modules by direct contact of their sides.

Just as in the previous embodiments, the blocks of each pair 1—1, 2—2 and 3—3, opposite to one another, exhibit the same color, while the central block or nucleus A is differentiated from all the others by means of a distinct color or combination of colors.

In this embodiment, given the hexagonal shape of all the blocks of each module, the center of the board, no matter what the number of modules which enter into its composition, will always be occupied by the center block or nucleus A of the corresponding module.

In all the embodiments, the blocks of each and every one of the colors each form winding paths, which cover the whole board and which cross over one another, and potentially capable of being moved through with the help of two dice: one, with points, which determines the number of blocks to be moved through each time and, the other, provided with the same colors as exhibited by the blocks on its faces, which indicates the particular path that is to be followed, while the center blocks or nuclei A of the modules can be used, located at regular intervals on all the paths, as crossing points or doors of entrance and exit, through which it is possible to move from one block to another of the same color, to follow the same path, or to another of a different color, to change path.

I claim:

1. A board for playing multiple board games, comprising: a plurality of modules, each module including a number of blocks surrounding a center block, which represents the center of nucleus of each module, said modules being arranged in such a way that together they compose a geometric figure, said surrounding blocks exhibiting different colors that differentiate them by pairs of blocks not adjacent to one another, said center block also exhibiting another color or combination of colors differentiated from all the other colors, said surrounding blocks being arranged in each and every one of the modules in such a way that those having the same color always occupy the same position with respect to the center block, and said center block borders with at least two surrounding blocks of each color.

2. A board for playing multiple board games, according to claim 1, wherein the center block of each one of the modules is contiguous with all the surrounding blocks, and said surrounding blocks are contiguous with blocks having the same color of adjacent modules.

3. A board for playing multiple board games, according to claim 1, wherein the center block of each one of the modules is contiguous with all the surrounding blocks, and said surrounding blocks are contiguous with blocks having a different color of adjacent modules.

4. A board for playing multiple board games, according to claim 1, wherein the center block of each one of the modules is non-contiguous with and connected via connection means to the surrounding blocks, said surrounding blocks are also connected via connection means to blocks having the same color of adjacent modules.

5. A board for playing multiple board games, according to claim 1, wherein the center block of each one of the modules is non-contiguous with and connected via connection means to the surrounding blocks, said surrounding blocks are connected via connection means to blocks having a different color of adjacent modules.

* * * * *

UNITED STATES PATENT AND TRADEMARK OFFICE

CERTIFICATE OF CORRECTION

PATENT NO. : 5,303,930

DATED : April 19, 1994

INVENTOR(S) : Aurelio SAIZ SAIZ

It is certified that error appears in the above—identified patent and that said Letters Patent is hereby corrected as shown below:

On the title page:

In Item [19], change the inventor's surname from "Saiz" to --Saiz Saiz--.

In Item [75], change the inventor's name from "Aurelio S. Saiz" to --Aurelio Saiz Saiz--.

Signed and Sealed this

Second Day of August, 1994

*Attest:*

Bruce Lehman

BRUCE LEHMAN

*Attesting Officer*

*Commissioner of Patents and Trademarks*